US011229285B1

(12) United States Patent
Spadavecchia et al.

(10) Patent No.: US 11,229,285 B1
(45) Date of Patent: Jan. 25, 2022

(54) CONTAINER RACK FOR PLIABLE BOTTLES

(71) Applicant: Polymer Solutions International Inc., Medford, NJ (US)

(72) Inventors: John A. Spadavecchia, Lynchburg, VA (US); Gerald Koefelda, Lake Bluff, IL (US); Daniel E. Kelly, Medford, NJ (US)

(73) Assignee: Polymer Solutions International Inc., Medford, NJ (US)

( * ) Notice: Subject to any disclaimer, the term of this patent is extended or adjusted under 35 U.S.C. 154(b) by 0 days.

(21) Appl. No.: 17/012,283

(22) Filed: Sep. 4, 2020

(51) Int. Cl.
*A47B 81/00* (2006.01)
*A47B 73/00* (2006.01)

(52) U.S. Cl.
CPC ..... *A47B 81/007* (2013.01); *A47B 73/00* (2013.01)

(58) Field of Classification Search
CPC ..... A47B 81/007; A47B 73/006; A47B 73/00
USPC ..... 211/85.18, 85.22
See application file for complete search history.

(56) References Cited

U.S. PATENT DOCUMENTS 3,501,018 A * 3/1970 Solo ..... B44B 1/00 211/60.1
3,802,595 A * 4/1974 Frahm ..... B65D 85/302 220/607
4,143,784 A * 3/1979 Frahm ..... B65D 85/302 215/12.1
4,391,377 A * 7/1983 Ziaylek, Jr. ..... A47B 81/007 206/443
4,520,941 A * 6/1985 Hagan ..... B65D 1/243 215/395
4,870,837 A * 10/1989 Weins ..... B65D 81/3883 62/457.4
6,026,958 A * 2/2000 Kelly ..... B65D 1/243 206/3
6,142,300 A 11/2000 Kelly et al.
6,170,789 B1 * 1/2001 Hayakawa ..... A47B 81/007 248/346.01
6,290,074 B1 * 9/2001 Syvuk ..... A47B 81/007 211/133.1
6,811,042 B2 * 11/2004 Kelly ..... A47B 87/0207 206/509
7,300,121 B2 * 11/2007 Diebold ..... A47B 73/00 312/408

(Continued)

FOREIGN PATENT DOCUMENTS

FR 3064643 A1 * 10/2018 ..... A47B 81/007

*Primary Examiner* — Stanton L Krycinski
(74) *Attorney, Agent, or Firm* — RatnerPrestia

(57) ABSTRACT

A container rack for pliable bottles, the container rack having a frame and one or more bottle receptacles extending in a horizontal direction into the frame. Each bottle receptacles has a liner wall having a generally circular profile as viewed along the horizontal direction, and a support wall extending radially inward from the liner wall within a lower-most quadrant of the generally circular profile of the liner wall. The support wall has a base portion and a plurality of ribs extending along the horizontal direction and protruding away from the base portion to respective distal ends with the base portion between the distal ends and the generally circular profile of the liner wall. The respective distal ends define a support surface configured to support at least one pliable bottle.

20 Claims, 4 Drawing Sheets

(56) References Cited

U.S. PATENT DOCUMENTS

| | | | | |
|---|---|---|---|---|
| 7,614,516 | B2 * | 11/2009 | Beggins | B65D 81/3879 215/386 |
| 8,100,273 | B2 * | 1/2012 | Apps | B65D 19/44 211/74 |
| 9,161,619 | B1 * | 10/2015 | Somers | A47B 47/0091 |
| 9,278,838 | B2 * | 3/2016 | Apps | B60P 1/00 |
| 9,630,032 | B2 * | 4/2017 | Unger | A62B 25/005 |
| 10,219,621 | B2 * | 3/2019 | Wilhelmsen | A47B 81/007 |
| 10,561,238 | B1 * | 2/2020 | Gutierrez | A47B 73/006 |
| 2008/0083683 | A1 * | 4/2008 | Apps | B65D 19/44 211/74 |
| 2016/0113396 | A1 * | 4/2016 | Wilhelmsen | A47B 81/007 211/72 |
| 2021/0147106 | A1 * | 5/2021 | Koefelda | B65D 71/0096 |

* cited by examiner

CONTAINER RACK FOR PLIABLE BOTTLES

BACKGROUND TO THE INVENTION

Large-format drinking water bottles, such five-gallon water bottles and the like, are often stored and shipped in modular racks that are configured to hold multiple water bottles in a horizontal orientation. These racks typically are formed from molded plastic, and have multiple cylindrical bottle receptacles for receiving individual bottles, or bottles placed end-to-end. The cylindrical receptacles prevent the bottles from rolling laterally, and prevent the bottles from bearing vertically on each other.

The bottle receptacles often include multiple holes extending laterally or vertically though the inner wall of the bore. Such openings allow the bottles to be viewed, reduce the weight of the rack and allow hand access to place or remove the bottles. Bottles stored in such racks are generally self-supporting, such that they do not significantly deform while being installed in or held by the rack. Thus, the presence of the lateral holes has no significant effect on installing, storing or removing the bottles from the bores.

While such racks are in common use, the inventors have found that such racks are ill-suited to handle relatively pliable water bottles. In particular, it has been found that pliable bottles tend to deform as they are being inserted into and removed from the receptacles. Such deformation can damage the bottle. For example, the bottle can deform when it passes over the edge of the receptacle, and can deform into openings within the receptacle, leading to potentially-damaging catching on and friction with the rack, and increasing the difficulty of removal and installation. Such problems are exacerbated when the rack or bottle has sediment such as dirt or sand on the surface (a condition that is particularly common in certain global regions). For example, friction with sand on the rack can scratch and eventually pierce the bottle. Still further, labels affixed to pliable bottles are typically loosely connected to the bottle, and thus do not remain in contact across their entire surface when the pliable bottle deforms. When this happens, the label protrudes form the bottle's surface, and can be torn or stripped when the bottle is inserted into or removed form a rack. Attempts have been made to address these problems by providing a sheet of corrugated cardboard between the bottle and the receptacle, but this has proved to be an impartial solution due to the lack of durability of the cardboard, and its inability to survive washing with water.

Having identified that particular issues are present when pliable bottles are used with conventional bottle racks, the inventors have determined that the state of the art of bottle storage racks can still be advanced.

SUMMARY OF THE INVENTION

In a first exemplary aspect, there is provided a container rack for pliable bottles. The container rack has a frame and one or more bottle receptacles extending in a horizontal direction into the frame. Each of the bottle receptacles has a liner wall having a generally circular profile as viewed along the horizontal direction, and a support wall extending radially inward from the liner wall within a lower-most quadrant of the generally circular profile of the liner wall. The support wall has a base portion and a plurality of ribs extending along the horizontal direction and protruding away from the base portion to respective distal ends with the base portion between the distal ends and the generally circular profile of the liner wall, wherein the respective distal ends define a support surface configured to support at least one pliable bottle.

In some examples, the frame is configured to be stacked on top of or below a frame of another container rack.

In some examples, the liner wall terminates at a front edge, and the support wall is spaced from the front edge along the horizontal direction.

In some examples, the liner wall terminates at a front edge, and the support wall comprises a leading edge that tapers towards the front edge.

In some examples, one or more of the plurality of ribs extends to form at least a part of the leading edge.

In some examples, the support wall terminates in a lateral direction at a first lateral side wall and a second lateral side wall, wherein each of the first lateral side and the second lateral side wall is tapered from the base portion to the liner wall.

In some examples, the support wall subtends an angle of less than 90 degrees relative to a geometric center of the generally circular profile of the liner wall.

In some examples, the support wall subtends an angle of less than 70 degrees relative to a geometric center of the generally circular profile of the liner wall.

In some examples, the plurality of ribs comprises twelve to forty ribs.

In some examples, the plurality of ribs comprises twenty-four ribs.

In some examples, the ribs extend parallel to the horizontal direction.

In some examples, the plurality of ribs comprises a first set of ribs on a first side of a lateral centerline of the support wall, second set of ribs on a second side of the lateral centerline, and an open drainage gap between the first set of ribs and the second set of ribs.

In some examples, the liner wall comprises one or more drainage openings adjacent the drainage gap to provide a fluid path vertically downward from the support wall and through the support frame.

In some examples, the plurality of ribs comprises inner ribs located proximal to a lateral centerline of the support wall, and outer ribs located distal from the lateral centerline, with the inner ribs between the outer ribs, and wherein the respective distal ends of the inner ribs are further from the generally circular profile of the liner wall than the respective distal ends of the outer ribs.

In some examples, the liner wall and the support wall are integrally molded with the frame.

In some examples, the ribs are configured to support a majority of a weight of the pliable bottle when the container rack is in a static in-use position.

In some examples, the ribs are configured to support a pliable bottle without contact between the pliable bottle and the liner wall when the container rack is in a static in-use position In another exemplary embodiment, the ribs are configured to reduce friction between the pliable bottle and any sediment on the pliable bottle and the container rack when the pliable bottle is removed from or inserted into the bottle receptacle.

In another exemplary embodiment, at least some of the plurality of ribs protrude away from a respective adjacent surface of the base portion by a distance of at least about 0.04 inches.

In another exemplary embodiment, at least some of the plurality of ribs protrude away from a respective adjacent surface of the base portion by a distance of at least about 0.09 inches.

BRIEF DESCRIPTION OF THE DRAWINGS

The following drawings are provided to help explain embodiments described herein, and are not intended to limit the scope of the appended claims. Like reference numbers refer to like features.

DESCRIPTION OF EMBODIMENTS

The following provides a description of various exemplary embodiments of the invention, as used in the context of a modular container rack for holding multiple pliable bottles, such as water bottles. It will be appreciated that these examples are not limiting. Other embodiments may be used in racks for holding individual bottles, in bottle transport mechanisms (e.g., robotic bottle conveyors) or in other applications.

Figure 1:
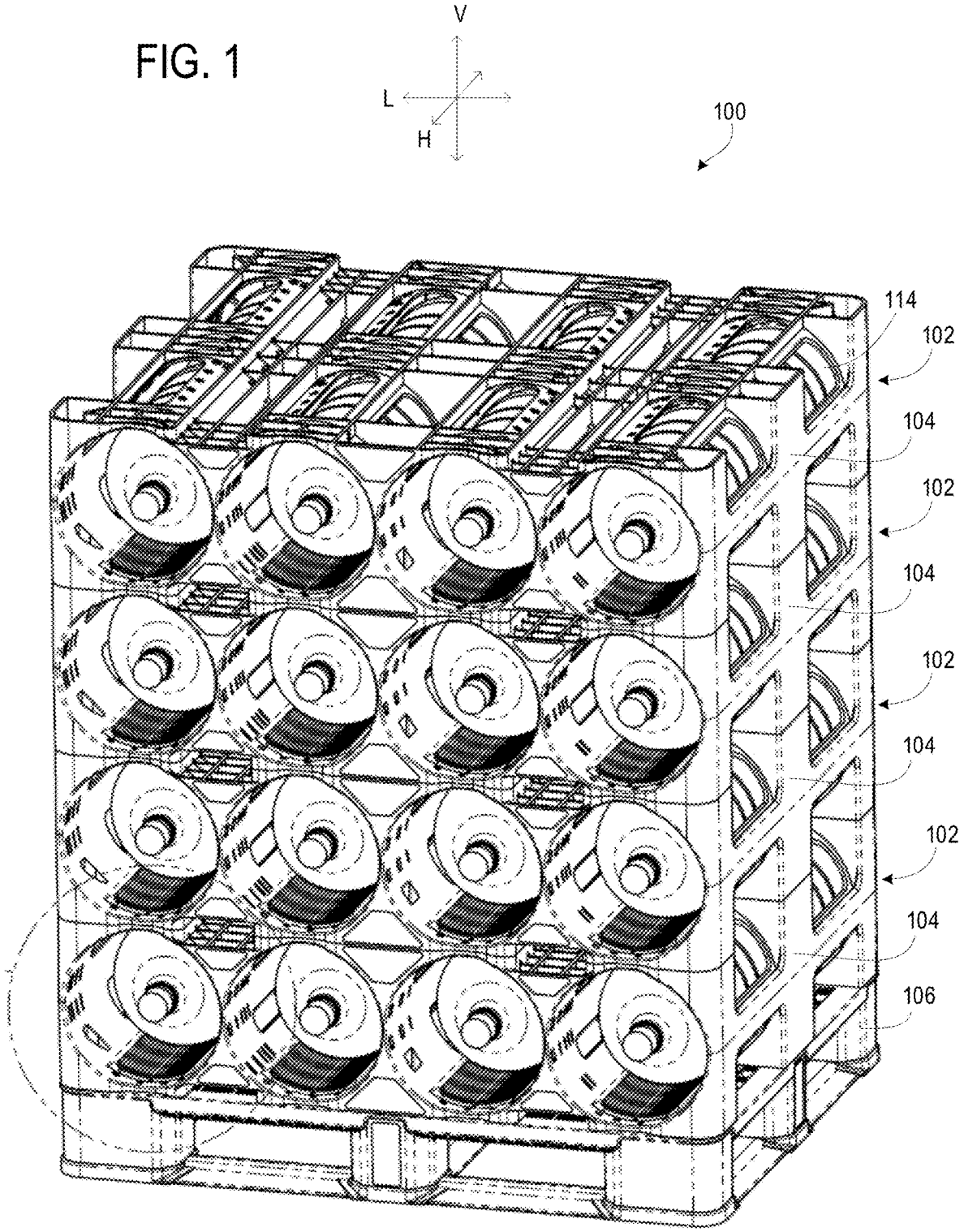
FIG. 1 is an isometric view of a rack system incorporating embodiments of the invention.
Figure 2:
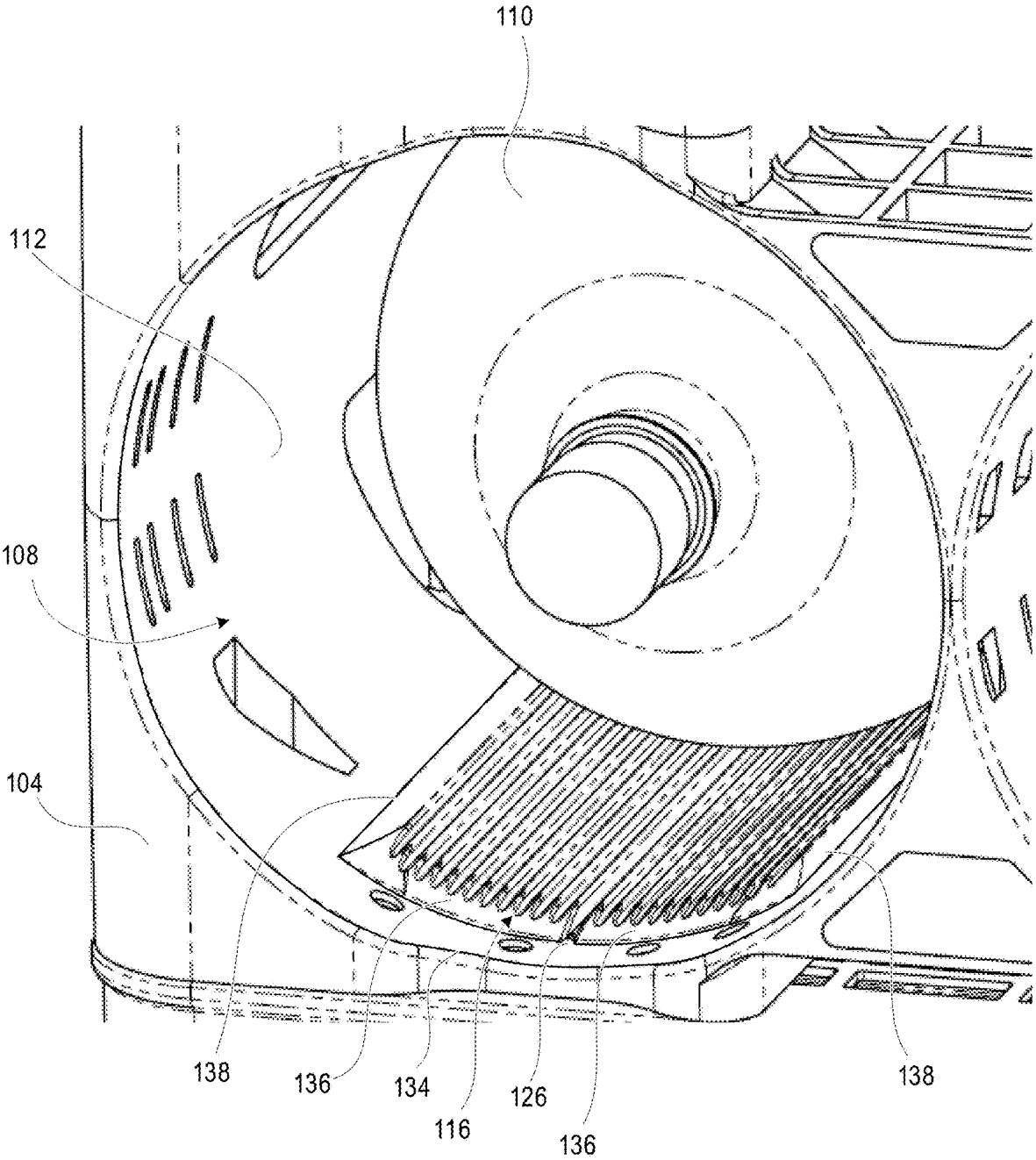
FIG. 2 is detail view of one bottle receptacle of FIG. 1.

FIGS. 1 and 2 are isometric views of an exemplary embodiment of a rack system 100 having multiple stacked container racks 102. Each container rack 102 has a structural frame 104 that is configured to support the rack 102. The entirety of each container rack 102 may be formed by the frame 104, or the rack 102 may include other structures (e.g., liners, labels, elastomeric bumpers or feet, connectors, etc.) that are attached to the frame 104 to form an assembled rack 102. Each rack 102 preferably is configured to stack onto another, preferably identical, rack 102. To this end, the frame 104 of the rack 102 may be configured with structural supports extending vertically through the rack 102, and upper and lower mounting points that engage each other when stacked with other racks 102.

Any suitable material may be used for the frame 104, such as polyethylene, polypropylene, or resins such as engineering resins. The frame 104 may be constructed as a unitary part, or as an assembly of parts, and each part may be made by injection molding, rotational molding, blow molding or other methods. The general construction of stackable container racks 102 is known in the art, and need not be described in more detail herein. Exemplary modular rack constructions are described in U.S. Pat. Nos. 6,142,300 and 6,026,958, which are incorporated herein by reference.

The rack system 100 may also include a pallet 106 that supports the lowermost rack 102. The pallet 106 may be configured with openings or the like to be moved by fork trucks, pallet movers, or other equipment.

Each rack 102 has one or more bottle receptacles 108. In this case there are four receptacles 108 for each rack 102, and each receptacle is deep enough in the horizontal direction H to hold two bottles 110. Different numbers and arrangements of receptacles 108 may be used in other embodiments. As used herein, the term "horizontal" refers to a horizontal direction along the length of the receptacles 108, and perpendicular to the gravitational direction when the rack 102 is in its normal operating position, "lateral" refers to a direction transverse to the horizontal direction and perpendicular to the gravitational direction when the rack 102 is in its normal operating position, and "vertical" refers to the gravitational direction when the rack 102 is in its normal operating position. the horizontal direction H, lateral direction L and vertical direction V are illustrated in FIG. 1.

The receptacles 108 preferably are formed integrally with the frame 104, such as by being formed by openings in the frame 104. In this example, each receptacle 108 is formed by a liner wall 112 that is molded directly into the frame 104. In other cases, the liner wall 112 may be a separate part that is inserted into or attached to the frame 104, or other constructions may be used. The liner wall 112 has a generally circular profile as viewed along the horizontal direction, such that it can receive a cylindrical bottle 110 and hold the bottle 110 against rolling or large lateral or vertical movements. The liner wall 112 may have various openings, such as side openings 114, to reduce weight, facilitate manufacture, improve access and visibility of the bottles 110, or for other reasons. The liner wall 112 also may have slots or openings that extend partially or entirely along the horizontal length of the liner wall 112, such as a laterally-extending slot between two adjacent receptacles 108. Thus, the generally circular profile of the liner wall 112 may be interrupted at places by openings. The generally circular profile also may be an imperfect circle, as might result from normal manufacturing variations, or through the addition of intentional minor variations in shape (e.g., making the profile somewhat ovate or flattened at the top or sides to reduce its overall size while still allowing admission of the desired bottle size). Other alternatives and variations will be apparent to persons of ordinary skill in the art in view of the present disclosure.

Figure 3A:
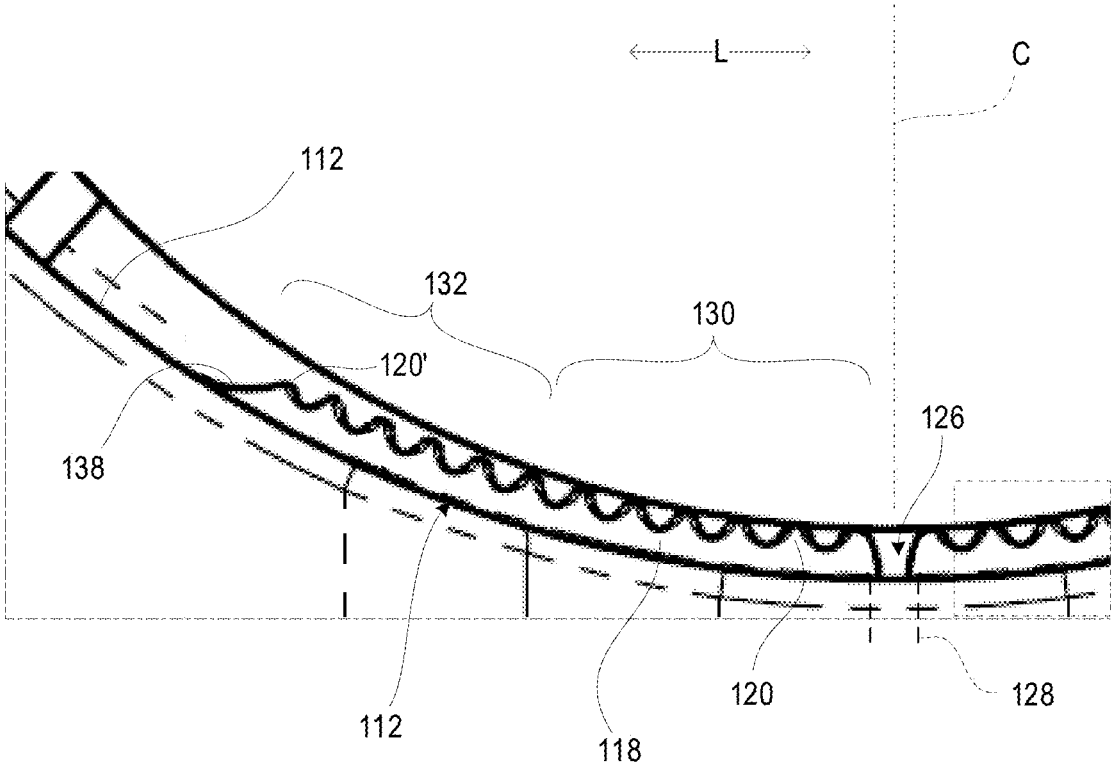
FIG. 3A is a front partial view of a bottle receptacle of FIG. 1.
Figure 3B:
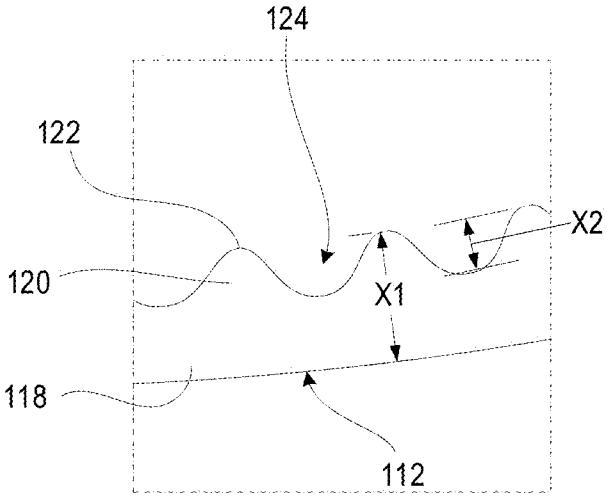
FIG. 3B is an detail view of the portion of FIG. 3A bounded by broken lines.
Figure 4:
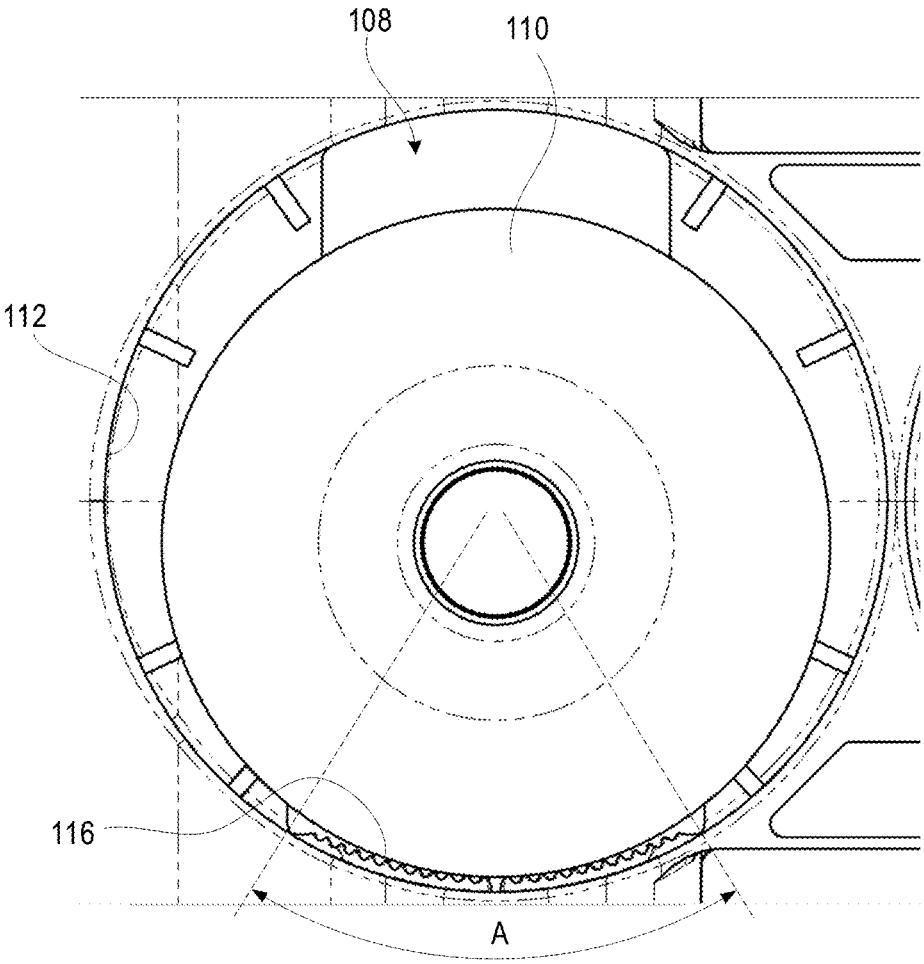
FIG. 4 is a front view of a bottle receptacle of FIG. 1.

Referring now more particularly to FIGS. 2-4, each receptacle 108 also includes a support wall 116 that extends radially inward from the liner wall 112. The support wall 116 may be integrally formed with the frame 104, formed separately and attached to the frame 104, entirely or partially overmolded onto the frame 104, 3D printed onto the frame 104, or otherwise constructed. The support wall 116 is located within a lower-most quadrant of the generally circular profile of the liner wall (i.e., at the bottom in the vertical direction V), where it is positioned to support the bottle 110. The support wall preferably subtends an angle A of less than 90 degrees, and more preferably less than 70 degrees, relative to a geometric center (as measured excluding any gaps as viewed along the horizontal direction H) of the generally circular profile of the liner wall 112.

The support wall 116 has a base portion 118, and a plurality of ribs 120 extending from the base portion 118. The ribs 120 extend along the horizontal direction H, and may be parallel to each other and parallel to the horizontal direction H. Each rib 120 protrudes away from the base portion 118 to a respective distal end 122, leaving gaps 124 between each adjacent pair of ribs 120. The base portion 118 thus lies radially between the distal ends 122 and the generally circular profile of the liner wall 112. The distal ends 122 of the ribs 120 collectively define a support surface that is configured to support at least one pliable bottle 110.

It has been found that a support surface formed by the ribs 120 is particularly beneficial for handling pliable bottles. Without being bound to any theory of operation, it is believed that distributing the bottle's weight across multiple ribs 120 helps prevent the generation of large areas of contact as the bottle 110 slides into and out of the receptacle 108, which is believed to help prevent labels from being stripped off the bottles. It is also believed that, in the presence of water or other liquid on the bottle 110 or receptacle 108, such water does not form large contact areas that might otherwise generate suction lock that pulls on the label as the bottle 110 is moved. Still further, the gaps 124 between the ribs 120, are expected to allow sediment to fall away from the support surface formed by the distal ends 122 of the ribs 120, thus reducing the negative effect of such contaminants. The gaps 124 also facilitate cleaning the receptacle 108, as a relatively brief wash with sprayed water or compressed air can move the sediment off the distal ends 122 of the ribs 120. Thus, even if the wash is not complete, any remaining sediment is likely to be located in the gaps 124 where they cause relatively little or no harm.

In a preferred embodiment, the ribs 120 are configured such that they reduce friction between rack 102 and the bottle 110 (including any sediment on the bottle 110). This is expected to be accomplished by providing ribs 120 as discussed herein, and can be a function of both distribution of forces and enhancing the ability to evacuate sediment via the gaps 124. If desired, a coating or layer of additional material may be provide on the ribs 130 to help reduce friction.

Furthermore, the ribs 120 are preferably configured such that the bottle 110 rests entirely or primarily on the ribs 120, with little or no weight being supported by the liner wall 112 during the normal in-use orientation of the rack 102. For example, the ribs 120 may be configured such that the bottle 110 does not touch any part of the liner wall 112 when the bottle 110 is at rest in the receptacle 108.

Embodiments may have any number of ribs 120 suitable to improve the handling of pliable bottles. In the shown example, there are twenty-four ribs, with twelve ribs on each lateral side of the receptacle's lateral centerline C. Other embodiments may have fewer or more ribs 120. For example, embodiments may have twelve to forty ribs 120. It expected that, when the number of ribs is too small, a pliable bottle will experience deformation as it wraps around the ribs, whereas if the number of ribs is too great the bottle may experience excessive friction and the gaps 124 may be less effective at clearing debris. The exact number of ribs 120 for any given application (e.g., bottle size, relatively pliability, bottle and rack materials, operating environment, etc.) can be determined by empirical testing or other routine experimentation.

The ribs 120 may extend fully or partially along the length of the support wall 116 in the horizontal direction H. Full-length ribs 120 may facilitate ease of manufacture and provide uniform support without potential to catch on the bottle 110. Partial length ribs 120 may help encourage drainage, towards the lower points on the support wall 116. For example, partial-length ribs 120 may be placed end-to-end along the horizontal direction H, with drainage gaps between them. As another example, drainage may be enhanced by making the ribs 120 angled towards the lowest point on the support wall 116 (e.g., helical or the like), to help encourage water and debris from the ribs 120. Other alternatives and variations will be apparent to persons of ordinary skill in the art in view of the present disclosure.

In some embodiments, the support wall 116 may be divided into multiple segments. For example, the support wall 116 may be divided by a gap 126 located at the lateral centerline C of the support wall 116 (which may be coincident with the lateral centerline C of the receptacle 108), where the support wall 116 reaches its lowest vertical point. In this way, the gap 126 can act as a central drainage gap for removing debris and liquids this might accumulate on the support wall 116. The gap 126 also may overlie a one or more drainage openings 128 formed in the liner wall 112 to provide a fluid path vertically down through the frame 104.

The ribs 120 may protrude any suitable first distance X1 from the generally circular profile of the liner wall 112 to their respective distal ends 122 and any suitable second distance X2 from the underlying region of the base portion 118. First distances X1 of about 0.187 to about 0.250 inches, and second distances X2 of about 0.09 inches have been found to be effective, but other first distances X1 and second distances X2 may be suitable in certain circumstances, as will be apparent with routine experimentation. For example, the second distances X2 may be selected to be at least about 0.04 inches in some applications, or at least about 0.09 inches in other applications. The second distances X2 may be increased to provide greater debris retention and separation from the bottle 110 in embodiments intended to be used in environments having greater volumes of debris (e.g., relatively arid or dusty regions) or in environments where debris is likely to be larger in size (e.g., sandy regions or locations with blasted rock such as quarries and mines). It will be understood that the dimensions described herein are exemplary, and the identified specific dimensions are nominal values which will, in practice, have some deviation due to manufacturing tolerances and the like.

The ribs 120 may all protrude by the same distances X1, X2. Alternatively, individual ribs 120 or groups of ribs 120 may protrude at different distances X1, X2. One or more ribs 120 also may protrude at a varying distances X1, X2, such as a distance X2 that increases from zero to a final maximum distance over a horizontal span, so as to provide a ramped rib shape.

The rib protrusion distances X1, X2 may be selected to change the manner in which the bottle 110 rests on the support wall 116, and the manner in which debris is able to be released from and separated from the bottle 110. For example, as shown in FIG. 3A, the ribs 120 may be divided into inner ribs 130 located proximal to the centerline C, and outer ribs 132 located distal from the centerline C (i.e., with the inner ribs 130 located in the lateral direction L between the outer ribs 132 and the centerline C). The inner ribs 130 may protrude a greater first distance X1 from the profile of the liner wall 112, while the outer ribs 132 protrude a lesser first distance X1 from the profile of the liner wall 112. Thus, collectively the ribs 120 provide a flatter surface than the profile of the liner wall 112. This allows a pliable bottle to deform to a flatter shape, which may help decentralize the supporting forces in the lateral direction L. As another example, the outermost rib 120' or ribs may have a smaller second distance X2 than the inner ribs 120, such as shown in FIG. 3A, or one or more groups of ribs 120 may have greater second distances X2 to provide greater volume to capture and retain debris out of contact with the bottle 110 to prevent scratching or other damage. Other alternatives and variations will be apparent to persons of ordinary skill in the art in view of the present disclosure.

Embodiments of support walls 116 also may include additional features to help mitigate problems associated with pliable bottles. For example, as shown in FIG. 2, the support wall 116 may be spaced in the horizontal direction H from the front edge 134 of the liner wall 112. The support wall 116 also may terminate in the horizontal direction H at a leading edge 136 that tapers towards the front edge 134. In this case, the leading edge 136 gradually transitions from the liner wall 112 to the upper extent of the base portion 118 and/or to the distal ends 122 of the ribs 120. In the shown example, one or more of the ribs 120 extend into and form part of the tapered leading edge 136, such that the ribs 120 are tapered, and located above a similarly tapered front portion of the base portion 118. In other cases, the base portion 118 may not protrude from the liner wall 112, in which case only the ribs 120 may be tapered to form the tapered leading edge 136. The tapered leading edge 136 is expected to help alleviate potentially damaging deformations and stresses as the bottle 110 is inserted into and removed from the receptacle 108.

The support wall 116 also may terminate in the lateral direction L at tapered lateral side walls 138, which may help prevent excess stresses from developing between the most lateral ribs 120 and the bottle 110.

The present disclosure provides examples of embodiments of a bottle rack that is adapted to better handle pliable bottles. It will be appreciated that embodiments may nevertheless be used with conventional rigid bottles, or with other objects such as bags of solid goods or the like. It will also be appreciated that features of embodiments may be used without other features, or in different combinations, to beneficial effect. Furthermore, it will be appreciated that certain features of the embodiments may be selected for ornamental design and are not dictated by practical function. For example, the shapes of the grooves 124 between the ribs, the proportions of the ribs 120 to each other and to the other parts, such as the tapered leading edge 136, the placement of the ribs relative to the centerline C, the number, density and length of the ribs 120, and other features may be selected based to some degree or entirely according to aesthetic preferences. Accordingly, design elements of these features can be varied and selected while maintaining functionality, such that a variety of ornamental configurations are available with substantially the same function or performance.

The invention claimed is:

1. A container rack for pliable bottles, the container rack comprising:

a frame;

one or more bottle receptacles extending in a horizontal direction into the frame, each of the bottle receptacles comprising:

a liner wall having a generally circular profile as viewed along the horizontal direction, and a support wall extending radially inward from the liner wall within a lower-most quadrant of the generally circular profile of the liner wall, the support wall comprising a base portion and a plurality of ribs extending along the horizontal direction and protruding away from the base portion to respective distal ends with the base portion between the distal ends and the generally circular profile of the liner wall, wherein the respective distal ends define a support surface configured to support at least one pliable bottle;

wherein the liner wall terminates at a front edge, and the support wall comprises a leading edge that tapers towards the front edge.

2. The container rack of claim 1, wherein the frame is configured to be stacked on top of or below a frame of another container rack.

3. The container rack of claim 1, wherein the liner wall terminates at a front edge, and the support wall is spaced from the front edge along the horizontal direction.

4. The container rack of claim 1, wherein one or more of the plurality of ribs extends to form at least a part of the leading edge.

5. The container rack of claim 1, wherein the support wall terminates in a lateral direction at a first lateral side wall and a second lateral side wall, wherein each of the first lateral side and the second lateral side wall is tapered from the base portion to the liner wall.

6. The container rack of claim 1, wherein the support wall subtends an angle of less than 90 degrees relative to a geometric center of the generally circular profile of the liner wall.

7. The container rack of claim 1, wherein the support wall subtends an angle of less than 70 degrees relative to a geometric center of the generally circular profile of the liner wall.

8. The container rack of claim 1, wherein the plurality of ribs comprises twelve to forty ribs.

9. The container rack of claim 1, wherein the plurality of ribs comprises twenty-four ribs.

10. The container rack of claim 1, wherein the ribs extend parallel to the horizontal direction.

11. The container rack of claim 1, wherein the plurality of ribs comprises a first set of ribs on a first side of a lateral centerline of the support wall, a second set of ribs on a second side of the lateral centerline, and an open drainage gap between the first set of ribs and the second set of ribs.

12. The container rack of claim 11, wherein the liner wall comprises one or more drainage openings adjacent the drainage gap to provide a fluid path vertically downward from the support wall and through the liner wall.

13. The container rack of claim 1, wherein the plurality of ribs comprises inner ribs located proximal to a lateral centerline of the support wall, and outer ribs located distal from the lateral centerline, with the inner ribs between the outer ribs, and wherein the respective distal ends of the inner ribs are further from the generally circular profile of the liner wall than the respective distal ends of the outer ribs.

14. The container rack of claim 1, wherein the liner wall and the support wall are integrally molded with the frame.

15. The container rack of claim 1, wherein the ribs are configured to support a majority of a weight of a pliable bottle when the container rack is in a static in-use position.

16. The container rack of claim 1, wherein the ribs are configured to support a pliable bottle without contact between the at least one pliable bottle and the liner wall when the container rack is in a static in-use position.

17. The container rack of claim 1, wherein the ribs are configured to reduce friction between the at least one pliable bottle, plus any sediment on the at least one pliable bottle and the container rack, when the at least one pliable bottle is removed from or inserted into the bottle receptacle.

18. The container rack of claim 1, wherein at least some of the plurality of ribs protrude away from a respective adjacent surface of the base portion by a distance of at least about 0.04 inches.

19. The container rack of claim 1, wherein at least some of the plurality of ribs protrude away from a respective adjacent surface of the base portion by a distance of at least about 0.09 inches.

20. A container rack for pliable bottles, the container rack comprising:

a frame;

one or more bottle receptacles extending in a horizontal direction into the frame, each of the bottle receptacles comprising:

a liner wall having a generally circular profile as viewed along the horizontal direction, and a support wall extending radially inward from the liner wall within a lower-most quadrant of the generally circular profile of the liner wall, the support wall comprising a base portion and a plurality of ribs extending along the horizontal direction and protruding away from the base portion to respective distal ends with the base portion between the distal ends and the generally circular profile of the liner wall, wherein the respective distal ends define a support surface configured to support at least one pliable bottle;

wherein the liner wall terminates at a front edge, and the support wall is spaced from the front edge along the horizontal direction.

* * * * *